US009103055B2

(12) United States Patent
Matthies et al.

(10) Patent No.: US 9,103,055 B2
(45) Date of Patent: Aug. 11, 2015

(54) DEVICE FOR PRODUCING INTERTWINING KNOTS

(71) Applicants: Claus Matthies, Ehndorf (DE); Jan Westphal, Schülp (DE)

(72) Inventors: Claus Matthies, Ehndorf (DE); Jan Westphal, Schülp (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 0 days.

(21) Appl. No.: 14/109,092

(22) Filed: Dec. 17, 2013

(65) Prior Publication Data

US 2014/0103648 A1 Apr. 17, 2014

Related U.S. Application Data

(63) Continuation-in-part of application No. PCT/EP2012/057383, filed on Apr. 23, 2012.

(30) Foreign Application Priority Data

Jul. 15, 2011 (DE) ..... 10 2011 107 283
Jul. 27, 2011 (DE) ..... 10 2011 108 695

(51) Int. Cl.
*D02J 1/08* (2006.01)
*D04G 5/00* (2006.01)
*D02G 1/16* (2006.01)

(52) U.S. Cl.
CPC ..... *D04G 5/00* (2013.01); *D02G 1/162* (2013.01); *D02J 1/08* (2013.01)

(58) Field of Classification Search
CPC ..... D02G 1/161; D02G 1/162; D02G 1/16; D02J 1/08; D02J 1/06; D04G 5/00
USPC ..... 28/271–276, 252, 253, 219; 57/293, 57/908, 289, 350
See application file for complete search history.

(56) References Cited

U.S. PATENT DOCUMENTS 2,985,995 A * 5/1961 Bunting, Jr. et al. ..... 57/204
3,110,151 A * 11/1963 Bunting, Jr. et al. ..... 57/350

(Continued)

FOREIGN PATENT DOCUMENTS

DE 26 36 953 2/1978
DE 37 27 263 2/1989

(Continued)

OTHER PUBLICATIONS

PCT/EP2012/057383 International Preliminary Report on Patentability dated Jan. 21, 2014 (6 pages including English translation).

(Continued)

*Primary Examiner* — Amy Vanatta
(74) *Attorney, Agent, or Firm* — Brinks Gilson & Lione; G. Peter Nichols

(57) ABSTRACT

A device for producing intertwining knots in a multifilament thread has a rotating nozzle ring with an encircling guide groove on an outer casing and an encircling sealing surface on an inner casing. At least one nozzle bore opens radially into the guide groove and passes through the nozzle ring. The nozzle ring is guided on a stator that has an encircling sliding surface on its periphery for guiding the nozzle ring and that forms a pressure chamber having a chamber opening that opens into the sliding surface. The sealing surface of the nozzle ring interacts with the sliding surface of the stator in order to provide air sealing. The nozzle ring is formed in a pot-like manner with an end wall having a disc-like end sealing surface which interacts with an end sliding surface formed on an end side of the stator to provide air sealing.

12 Claims, 6 Drawing Sheets

(56) References Cited

U.S. PATENT DOCUMENTS

| | | | | | |
|---|---|---|---|---|---|
| 3,217,386 | A | * | 11/1965 | Clendening, Jr. | 68/3 R |
| 3,394,440 | A | * | 7/1968 | Van Holten | 28/275 |
| RE27,717 | E | * | 8/1973 | Breen | 57/283 |
| 3,923,125 | A | * | 12/1975 | Rosenthal | 184/6 |
| 3,937,252 | A | * | 2/1976 | Ishida | 137/624.13 |
| 3,952,386 | A | * | 4/1976 | Joly et al. | 28/271 |
| 4,058,960 | A | * | 11/1977 | Movshovich et al. | 57/293 |
| 4,949,440 | A | * | 8/1990 | Niederer et al. | 28/271 |
| 2012/0144633 | A1 | * | 6/2012 | Kaulitzki | 28/271 |
| 2013/0247341 | A1 | * | 9/2013 | Stundl | 28/254 |
| 2013/0263414 | A1 | * | 10/2013 | Kaulitzki et al. | 28/274 |

FOREIGN PATENT DOCUMENTS

| | | |
|---|---|---|
| DE | 4140469 | 6/1993 |
| DE | 195 01 309 | 8/1995 |
| GB | 2 321 651 | 8/1998 |
| WO | WO 2008/128863 | 10/2008 |

OTHER PUBLICATIONS

PCT/EP2011/066537 International Search Report dated Nov. 16, 2011 (4 pages including 2 page English translation).

PCT/EP2011/067043 International Search Report dated Dec. 13, 2011 (4 pages including 2 page English translation).

PCT/EP2011/066537 International Preliminary Report on Patentability dated Jun. 4, 2013 (6 pages).

PCT/EP2011/067043 International Preliminary Report on Patentability dated Jun. 25, 2013 (6 pages).

PCT/EP2012/057383 International Search Report dated Jan. 27, 2013 (4 pages including English translation).

U.S. Appl. No. 13/893,835, filed May 14, 2013.

U.S. Appl. No. 13/910,541, filed Jun. 5, 2013.

* cited by examiner

DEVICE FOR PRODUCING INTERTWINING KNOTS

This application is a continuation-in-part of and claims the benefit of priority from PCT application PCT/EP2012/057383 filed Apr. 23, 2012; German Patent Application No. 10 2011 107 283.0 filed Jul. 15, 2011; and German Patent Application No. 10 2011 108 695.5 filed Jul. 27, 2011, the disclosure of each is hereby incorporated by reference in its entirety.

BACKGROUND

The present invention relates to a device for producing intertwining knots in a multifilament thread.

A device for producing intertwining knots in a multifilament thread is known from DE 41 40 469 A1. In the production of multifilament thread it is generally known that the cohesion of the individual filament strands in the thread is produced by so-called intertwining knots. Such intertwining knots are produced by a compressed air treatment of the thread. In this connection, depending on the thread type and process, the desired number of intertwining knots per unit of length as well as the stability of the intertwining knots can be subject to differing requirements. For example, in the production of carpet yarns, which are processed immediately after a melt spinning process, a high knot stability as well as a high number of intertwining knots per unit of length of the thread is desired.

In the case of higher thread speeds, in order to achieve a relatively high number of intertwining knots, the known device has a rotating nozzle ring that interacts with a stationary stator. The rotating nozzle ring has a thread guide groove on the periphery into whose groove base over the periphery several uniformly distributed, radially aligned nozzle bores open. The nozzle bores penetrate the nozzle ring from the guide groove to an inner casing, which is guided on the periphery of the stator. The stator has an inner pressure chamber, which is connected by a chamber opening constructed on the periphery of the stator. The chamber opening on the stator, as well as the nozzle bores in the nozzle ring lie on a plane, so that in the event of rotation of the nozzle ring, the nozzle bores are fed in succession to the chamber opening. The pressure chamber is connected to a compressed air source so that, during the interaction of the nozzle bore and the chamber opening, a compressed air jet is produced in the thread guide groove of the nozzle ring.

The stator has an encircling sliding surface for guiding the nozzle ring, which interacts with a sealing surface constructed on the inner casing of the nozzle ring. In order to achieve the lowest possible loss of compressed air during the transfer of the compressed air from the pressure chamber to the nozzle bore of the nozzle ring, a sealing gap is formed between the sealing surface of the nozzle ring and the sliding surface of the stator. In this connection, it is necessary to design the longest possible distinctive sealing gaps at both sides of the nozzle ring in order to achieve the lowest possible losses of compressed air. However, such gap seals require a very narrow gap in order to obtain an effective sealing in spite of a gap length. However, a narrow gap is only possible through high production expenditure. In addition, gaps that are too narrow between the sealing surface of the nozzle ring and the sliding surface of the stator can lead to friction and thus considerable wear and tear issues through operational influences such as for example the centrifugal force, imbalance phenomena or heat development.

SUMMARY

Consequently, the present invention addresses the problem of improving the above-described device such that, in the event of compressed air transfer between the stator and the nozzle ring, the lowest possible losses of compressed air are achieved.

An additional objective of the invention involves further developing the above-described device such that a compact seal is possible between the stator and the nozzle, shielding from the environment as much as possible.

According to the present invention, the nozzle ring is formed in a pot-like manner with an end wall, wherein the end wall has a disc-like end sealing surface and the stator has an end sliding surface on one end side which interacts with the end sealing surface of the end wall in order to provide air sealing.

The present invention has the advantage that a sealing gap formed in axial direction between the nozzle ring and the stator has an essentially constant value in every operating state essentially independently from the centrifugal forces acting on the nozzle ring. In addition, the gap heights in the axial gap can be designed independently from the gap heights of a radial gap between the nozzle ring and the stator.

An additional advantage of the inventive device is the fact that the radial sealing gap formed between the sealing surface of the nozzle ring and the sliding surface of the stator is limited by the lateral end wall of the nozzle ring and hence does not have a direct connection to the environment. In addition, through the angular transition between the axial sealing gap and the radial sealing gap, greater sealing effects are produced.

In order to realize a secure operation with the lowest possible losses of air, the inventive device is preferably configured such that a radial gap between the sliding surface of the stator and the sealing surface of the nozzle ring has a gap height ranging from 0.01 mm to 0.1 mm.

The axial gap formed between the end sliding surface of the stator and the end sealing surface of the nozzle ring is advantageously constructed equal in its gap height to the radial gap. Thus, sliding contact and impermissible friction between the nozzle ring and the stator can be prevented. Both the surfaces limiting the radial gap as well as the surfaces limiting the axial gap can have additional coatings in order to minimize wear and tear even in the event of a brief sliding contact.

The sealing effect for providing air sealing between the stator and the nozzle ring can be improved by interrupting the sliding surface and/or the end sliding surface of the stator through several grooves designed next to one another. Thus, relief areas can be realized within the gaps that lead to an increase in the sealing effect.

The grooves in one of the sliding surfaces preferably have a constant groove depth and a constant groove width which lies preferably in a ratio between the groove width and groove depth in the range of 2 to 6. These ratios have proved to be especially advantageous, in particular in the case of primary pressures in the range of 2 to 10 bar within the pressure chamber of the stator.

As an alternative or in addition to this, the sealing surfaces and/or the end sealing surface of the nozzle ring can likewise be interrupted by several grooves designed next to one another.

When stator grooves are provided both in the end sealing surface of the nozzle ring as well as also in the end sliding surface, it is preferable to construct the grooves of the end sealing surface of the nozzle ring and the grooves of the end sliding surface of the stator to be offset to one another in order to produce an overlapping between the end sealing surface of the nozzle ring with the end sliding surface of the stator. Such labyrinth seals are especially well suited for achieving an intensive air sealing.

Such deflections within the sealing gap can also be realized by means of a further development in which the sealing surface of the nozzle ring and the sliding surface of the stator are constructed in steps.

To prevent the escape of residual amounts of air from the radial gap between the stator and the nozzle ring, provision is further made to arrange a sliding seal on the periphery of the stator, which interacts with a free end side of the nozzle ring. As a result, a hermetic seal of the radial gap between the stator and the nozzle ring can be realized.

When several nozzle bores are arranged next to one another, a transfer of compressed air between the nozzle bores can be advantageously prevented by a preferred embodiment of the invention, in which, in the section of the sliding surface on the periphery of the stator interrupted by the chamber opening, several axial transverse grooves are designed next to one another. In this way, the sections of the sliding surface between the nozzle bores are advantageously designed with relief areas so that a labyrinth-like seal occurs between adjacent nozzle bores.

According to one embodiment of the present invention, since the impulse-like stream of compressed air is produced by the interaction between the nozzle bore in the nozzle ring and the chamber opening in the stator, the swirling of the thread can be intensified providing a cover partially covering the guide nut such that the cover is associated with the nozzle ring opposite the chamber opening of the stator. Through the interaction of the cover with the nozzle ring, a treatment channel arises in which the compressed air impulse swirls the thread.

BRIEF DESCRIPTION OF THE DRAWINGS

The inventive device will be described in greater detail in the following with reference to the enclosed drawings.

DETAILED DESCRIPTION

Figure 1:
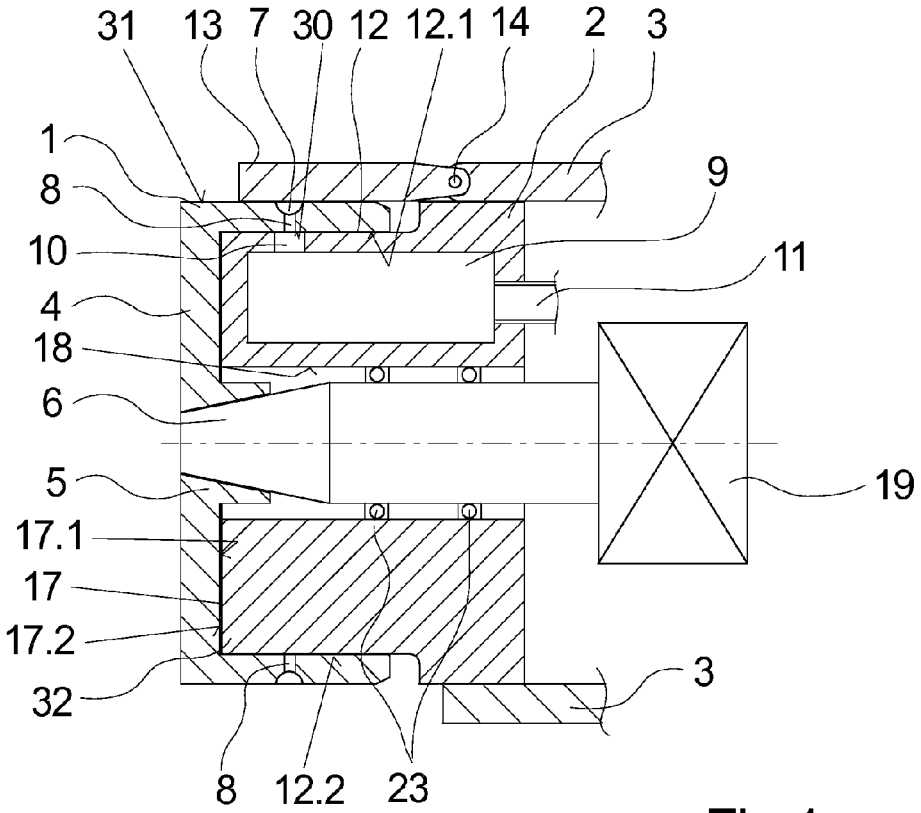
FIG. 1 schematically shows a longitudinal section view of a first embodiment of the inventive device.
Figure 2:
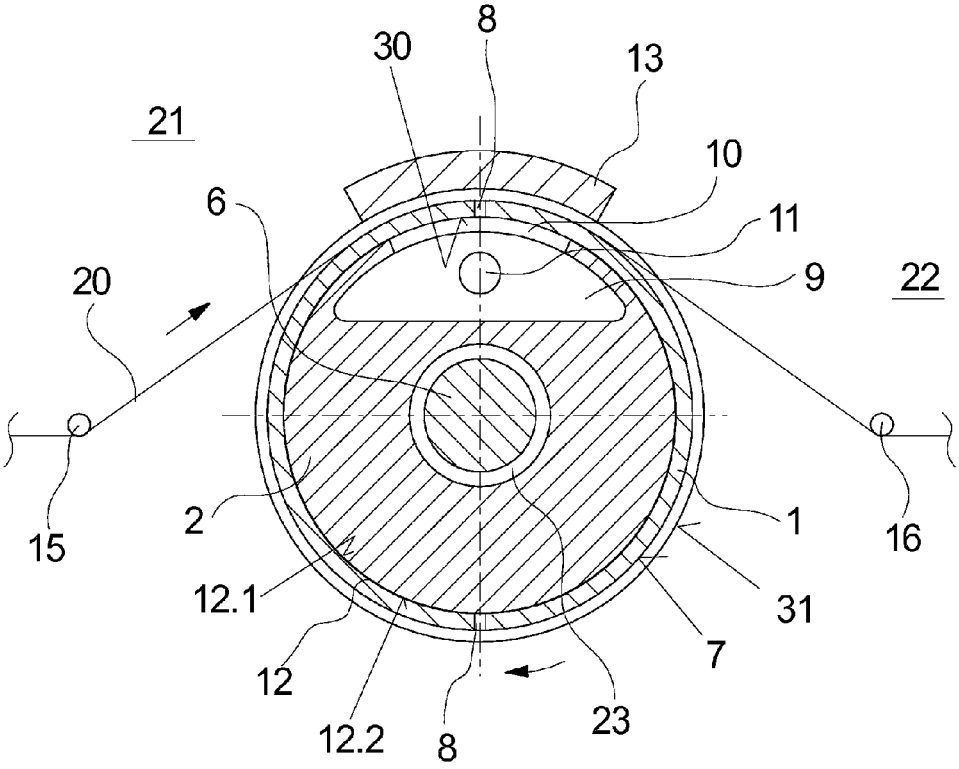
FIG. 2 schematically shows a cross-sectional view of the embodiment of FIG 1.

In FIGS. 1 and 2, a first embodiment of the inventive device is shown in several views. FIG. 1 shows the first embodiment in a longitudinal section and FIG. 2 shows the first embodiment in a cross-sectional view. If no express reference is made to one of the figures, the following description applies for both figures.

The first embodiment of the inventive devices for producing intertwining knots in a multifilament thread has a rotating nozzle ring 1, which is annular in design and includes an encircling guide groove 7 on an outer casing. Several nozzle openings 8 open into the groove base of the guide groove 7. The openings are uniformly distributed over the periphery of the nozzle ring. In this embodiment, two nozzle openings 8 are contained in the nozzle ring 1. The nozzle openings 8 penetrate the nozzle ring 1 to the inner casing 30. The number of nozzle openings 8 in the nozzle ring 1 can be any suitable number. The number is essentially determined by the desired number of knots per thread length.

The nozzle ring 1 is connected to a drive shaft 6 via an end wall designed on the end-side and a hub 5 centrally arranged on the end wall 4. To this end, the hub 5 is fastened on the free end of the drive shaft 6.

The inner casing 30 of the nozzle ring 1 is guided on a guide section of a stator 2, which forms a cylindrical sliding surface 12.2 lying opposite a sealing surface 12.1 designed on the inner casing 30 of the nozzle ring 1. A radial gap 12 acting as a sealing gap is formed between the sliding surface 12.2 of the stator and the sealing surface 12.1 of the nozzle ring. The radial gap 12 has a gap height ranging from 0.01 mm to 0.1 mm so that the nozzle ring 1 is guided on the periphery of the stator 2 without touching.

The stator 2 has a chamber opening 10 in one position on the periphery of the cylindrical sliding surface 12.2. The chamber opening 10 is connected to a pressure chamber 9 designed in the interior of the stator 2. The pressure chamber 9 is connected via a compressed air connection 11 to a compressed air source, not shown here. The chamber opening 10 in the cylindrical sliding surface 12.2 and the nozzle opening 8 in the sealing surface 12.1 of the nozzle ring are designed on a plane, so that by rotating the nozzle ring 1, the nozzle openings 8 are alternately guided into the region of the chamber opening 10. The chamber opening 10 is designed as an oblong hole and extends in a radial direction over a longer guide region of the nozzle bores 8. Thus, the size of the chamber opening 10 determines an opening time of the nozzle opening 8, while the nozzle opening produces an airstream impulse.

An axial gap 17 acting likewise as a sealing gap is designed between the end wall 4 of the nozzle ring 1 and the wall end 32 of the stator 2. To this end, the end wall 4 has a radial sealing surface 17.1, which interacts with an opposing end sliding surface 17.2 on the wall end 32 of the stator 2. The axial gap 17 can be designed the same, smaller, or even larger than the radial gap 12 on the periphery of the stator 2. The gap height ranges from about 0.05 mm to about 0.25 mm.

The stator 2 is held on a carrier 3 and has a central bearing bore 18, which is designed concentrically to the sliding surface 12.2. The drive shaft 6 is pivoted by the bearing 23 within the bearing bore 18.

The drive shaft 6 is coupled on one end to a drive 19, through which the nozzle ring 1 can be driven with predetermined rotational speed. The drive 19 could, for example, be formed by an electrical motor which is arranged laterally on the stator 2.

As can be seen from the representation in FIG. 1, a cover 13 is associated with the nozzle ring 1 on the periphery and the cover is movably held on the carrier 3 via a pivot axis 14.

As can be seen from the representation in FIG. 2, the cover 13 extends in a radial direction on the periphery of the nozzle ring 1 over a region including the chamber opening 10 of the stator 2. The cover 13 has an adapted covering surface on the side facing the nozzle ring 1. The covering surface completely covers the guide groove 7 on the outer casing 31 of the nozzle ring 1 and hence forms a treatment channel. In this region, a thread 20 is guided in the guide groove 7 on the periphery of the nozzle ring 1. To this end, on the nozzle ring 1 an inlet side 21 is associated with an inlet thread guide 15. And, an outlet thread guide 16 is associated with an outlet side 22. Thus, the thread 20 can be guided between the inlet thread guide 15 and the outlet thread guide 16 with a partial wrap on the nozzle ring 1 within the guide groove 7.

In the exemplary embodiment shown in FIGS. 1 and 2, compressed air is introduced into the pressure chamber 9 of the stator 2 to produce intertwining knots in the multifilament thread 20. The nozzle ring 1, which guides the thread 20 in the guide groove 7, produces periodic airstream impulses as soon as the nozzle openings 8 reach the region of the chamber opening 10. In this connection, the airstream impulses lead to local swirling on the multifilament threads 20 so that a sequence of intertwining knots develop on the thread. The lost quantity of compressed air within the radial gap 12 escaping in the transition of the compressed air from the chamber opening 10 to the nozzle bore 8 is sealed via the sealing effect of the radial gap 12 and of the axial gap 17. Thus, impermissible compressed airstreams outside of the nozzle bore 8 can be prevented.

In particular, in order to improve the sealing effect of the radial gap 12 between the stator 2 and the nozzle ring 1, the sliding surface 12.2 and/or the end sliding surface 17.2 of the stator 2 can be interrupted by several encircling grooves. To this end, an additional exemplary embodiment of the inventive device is shown in a partial section of a longitudinal section view in FIG. 3. This embodiment is identical to the embodiment according to FIGS. 1 and 2, so that only the differences will be explained here.

Figure 3:
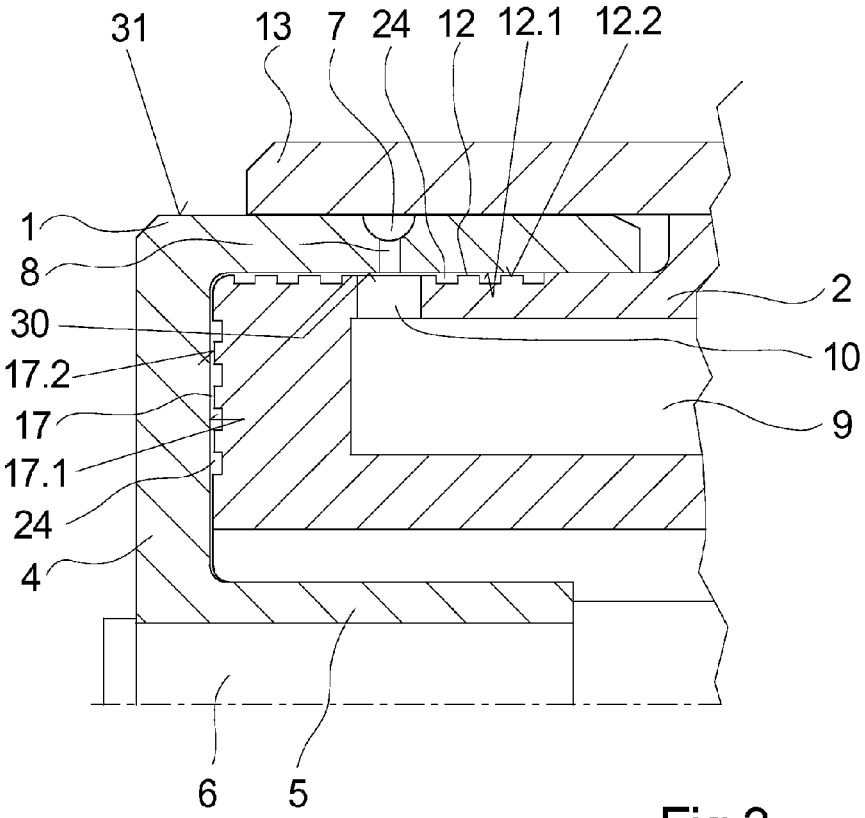
FIG. 3 schematically shows a partial view of a longitudinal section representation of a further embodiment of the inventive device.

As can be seen from the representation in FIG. 3, several encircling grooves 24 arranged parallel to one another are constructed in the sliding surface 12.2 of the stator 2. The grooves 24 are incorporated in the sliding surface 12.2 of the stator 2 and are uniformly distributed on both sides of the nozzle bores 8. Thus a plurality of relief areas can be realized in the radial gap 12, with the relief areas achieving a higher pressure reduction and thus higher sealing effect.

On the wall end 32 of the stator 2, the end sliding surface 17.2 is interrupted by several grooves 24 arranged concentrically to one another, so that the axial gap 17 is likewise complemented by relief areas.

The grooves 24 are preferably designed with a constant groove depth and a constant groove width on the sliding surfaces 12.2 and 17.2 or the sealing surfaces 17.1 or 12.1. For the formation of several relief areas, the grooves 24 are preferably designed with a ratio of 2 to 6 between groove width and groove depth. That is, the groove width is designed to be greater by a factor of 2 to 6 than the groove depth.

In the exemplary embodiment of the inventive device shown in FIG. 3, it is also contemplated to design the grooves 24 in the opposing sealing surface 12.1 and the end sealing surface 17.1 of the nozzle ring 1. In this connection, it is important that several pressure stages can develop within the radial gap 12 and the axial gap 17.

Figure 4:
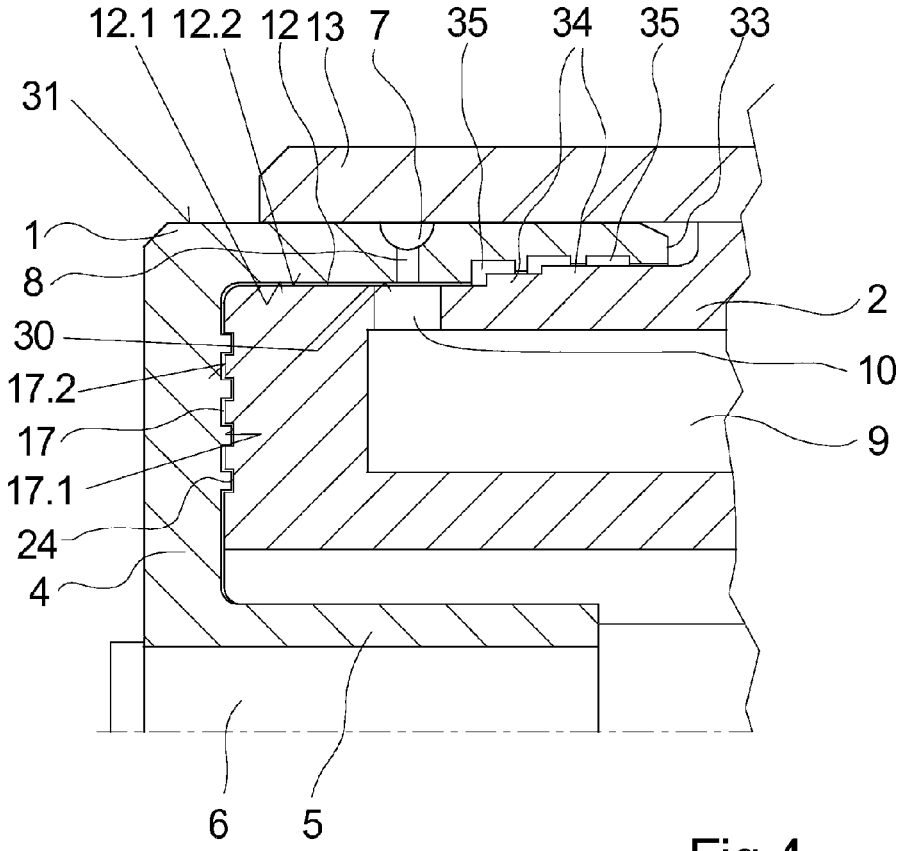
FIG. 4 schematically shows a partial view of a longitudinal section representation of a further embodiment of the inventive device.

In the exemplary embodiment according to FIGS. 1 through 3, the sealing surfaces and sliding surfaces of the radial gap 12 and of the axial gap 17 are designed identically in their machining. However, in principle the possibility also exists that the sealing surfaces and sliding surfaces of the radial gap 12 and of the axial gap 17 have different shapes. To this end, FIG. 4 shows a further exemplary embodiment of the inventive device. The exemplary embodiment in FIG. 4 shows a partial view of a longitudinal section view of the inventive device. In this connection, the radial gap 12 between the nozzle ring 1 and the stator 2 is divided into two sections which extend to both sides of the nozzle bore 8. In a longer designed section of the radial gap 12, between the nozzle bore 8 and a free end side 33 of the nozzle ring, the opposing sliding surface 12.2 and the sealing surface 12.1 are designed in steps. To this end, the sliding surface 12.2 has staggered steps 34 which interact with opposing step grooves 35 in the sealing surface 12.1 of the nozzle ring.

A relatively short radial gap 12 between the end wall 4 of the nozzle bore 8 is formed by smooth sections of the sliding surface 12.2 and the sealing surface 12.1. Hence, a constant encircling radial gap 12 is present here.

The axial gap 17 designed between the end wall 4 and the stator 2 is formed in this exemplary embodiment by offset grooves 24 in the end sealing surface 17.1 and in the end sealing surface 17.2. The offset between the grooves 24 in the end sealing surface 17.1 and the end sliding surface 17.2 is selected such that the end wall 4 of the nozzle ring 1 and the end side 32 of the stator engage in overlapping manner. Thus, the end sealing surface 17.1 and the end sliding surface 17.2 overlap. Additional sealing surfaces develop next to the relief areas.

Figure 5:
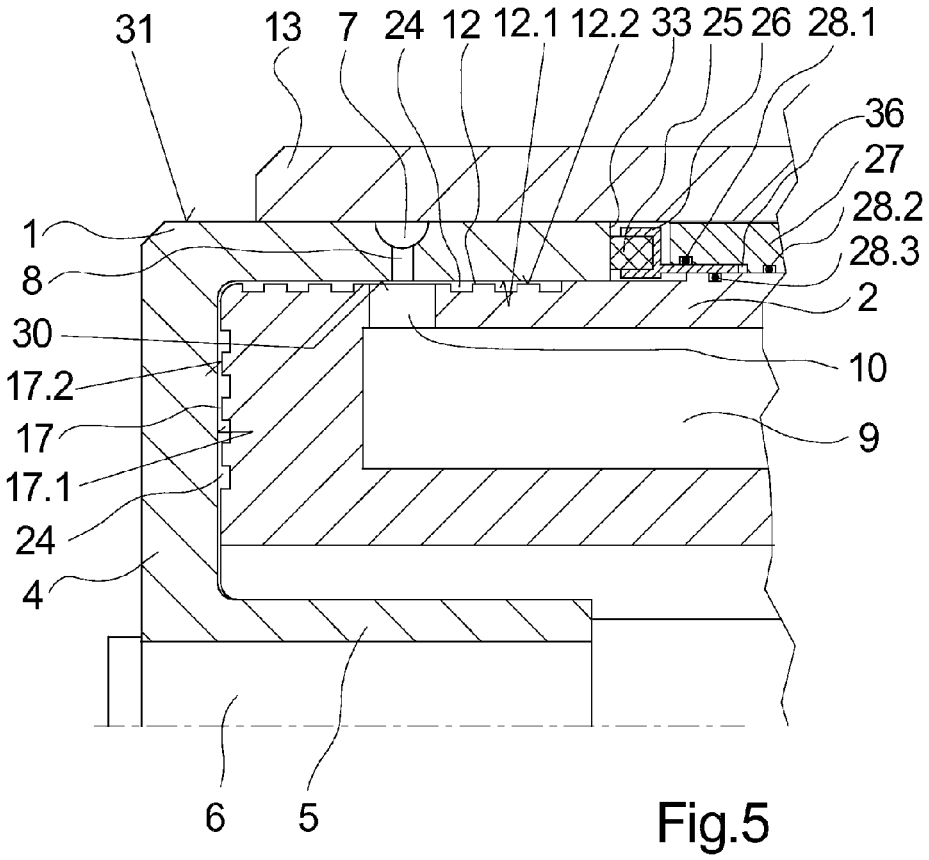
FIG. 5 schematically shows a partial view of a longitudinal section representation of a further embodiment of the inventive device.

FIG. 5 shows a further exemplary embodiment for improving the seal tightness of the inventive device. In the exemplary embodiment shown in FIG. 5, a partial view of a longitudinal section view is likewise depicted. The exemplary embodiment is essentially identical to the exemplary embodiment according to FIG. 3, so that reference is made to the previously mentioned description and only differences will be explained here.

In the exemplary embodiment shown in FIG. 5, the air sealing takes place in the transfer of the compressed air from the chamber increase 10 to the nozzle bore 8 first via the radial gap 12 and the axial gap 17. The associated sealing surfaces 12.1 and 17.1 as well as the associated sliding surfaces 12.2 and 17.2 are designed identically to the exemplary embodiment according to FIG. 3.

To prevent a residual airstream in the free end side 33 of the nozzle ring 1 from escaping to the radial gap 12, a pressure piston 26 and a piston bracket 27 are provided on the periphery of the stator 2. The piston bracket 27 and the pressure piston 26 are sealed via several seals 28.1, 28.2 and 28.3 on the periphery of the stator 2.

The pressure piston 27 interacts in axial direction on a sliding seal 25 which contacts the end side 33 of the nozzle ring 1. A pressure chamber 36 is provided on the opposing end of the pressure piston 26, with the pressure chamber being connected to a compressed air source. Hence, the pressure piston 26 can be supplied with compressed air so that the sliding seal 25 is in continuous contact with the free end side 33 of the nozzle ring 1. With this, the residual air escaping from the radial gap 12 can be reduced.

The exemplary embodiment shown in FIG. 5 is thus particularly well suited for achieving high seal tightness on the inventive device. The sliding seal 25 is preferably formed from graphite and can alternatively also be held by a spring preload on the end side 33 of the nozzle ring 1.

However, as an alternative, it is possible to not keep the sliding seal 25 in continuous contact with the free end side 33 of the nozzle ring 1. For example, the sliding seal 25 could be guided to a contact position at the beginning of the process, with the position in which the sliding seal 25 contacts the free end side 33 of the nozzle ring 1. This position of the sliding seal 25 is then fixed and held constant for a period of time during operation. Depending on the wear behavior of the sliding seal 25, the fixed location of the sliding seal 25 can change at predefined time intervals, so that, after contact between the sliding seal 25 and the end side 33 of the nozzle ring 1, it can be re-established. Thus, in particular, the friction between the sliding seal and the end side of the nozzle ring can be decreased during operation.

For further improvement of the air sealing in the transfer of the compressed air from the chamber opening 10 to the nozzle opening 8, provision is made in accordance with a further exemplary embodiment of the inventive device that, on the periphery of the stator 2, several transverse grooves 29 are provided in a section of the sliding surface 12.2 interrupted by the chamber opening 10.

Figure 6:
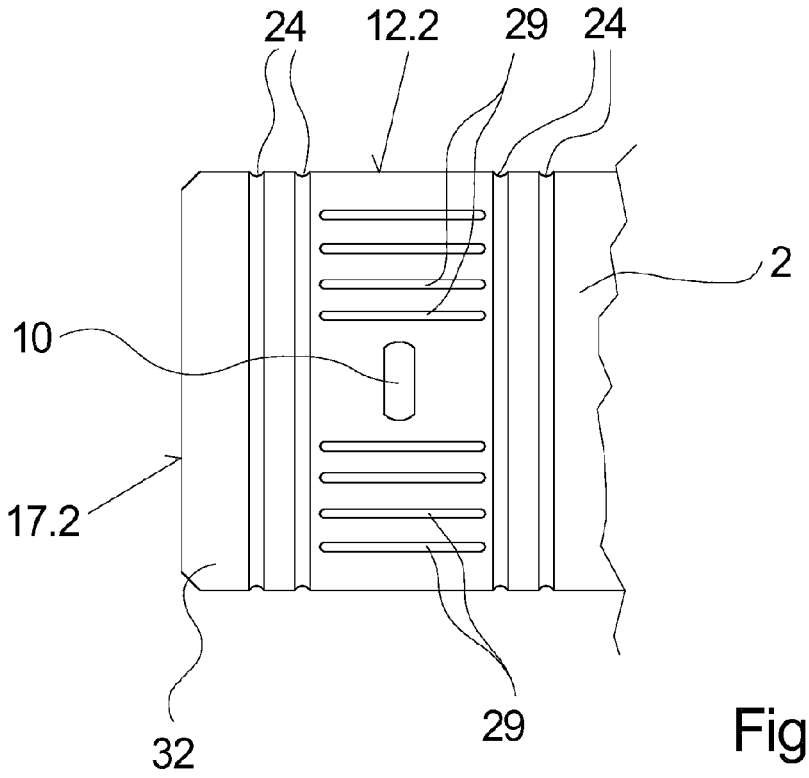
FIG. 6 schematically shows a view of a stator of a further embodiment of the inventive device.

To this end, FIG. 6 shows a view of the guide section of the stator 2 at which the nozzle ring 1 is guided. The sliding surface 12.2 has several encircling grooves 24 designed on both sides of the chamber opening. In the section of the sliding surface 12.2 interrupted by the chamber opening 10, several transverse grooves 29 are provided between the encircling grooves 24, with the transverse grooves being arranged on both sides of the chamber opening 10 and uniformly distributed. Thus, several pressure steps can also be produced in the peripheral direction on the plane of the chamber opening 10, with the pressure steps preventing the escape of the air entering into the radial gap 12 by adjacent nozzle bores 8 of the nozzle ring 1.

The exemplary embodiment according to FIG. 6 can also be designed alternatively such that in the sliding surface 12.2 on the periphery of the stator 2, the chamber opening 10 is connected by several transverse grooves and several longitudinal grooves so that several relief areas are formed around the chamber opening 10 both in radial direction as well as in the axial direction within the radial gap 12.

The variants shown in FIGS. 3 through 6 are only exemplary. In principle, the radial gap 12 and the axial gap 17 could also be designed by other contact-free sealing variants. In this connection, it is important that the nozzle ring 1 rotates on the stator without lubricants at high peripheral speeds up to a maximum of 70 m/sec., and in the process no significant pressure losses occur. The seal tightness of the inventive device is essential for the cost-effectiveness of the swirling. Thus permanent airstreams do not result in undesirable losses of compressed air.

Reference List

1 Nozzle ring
2 Stator
3 Carrier
4 End wall
5 Hub
6 Drive shaft
7 Guide groove
8 Nozzle opening
9 Pressure chamber
10 Chamber opening
11 Compressed air connection
12 Radial gap
12.1 Sealing surface
12.2 Sliding surface
13 Cover
14 Pivot axis
15 Inlet thread guide
16 Outlet thread guide
17 Axial gap
17.1 End sealing surface
17.2 End sliding surface
18 Bearing bore
19 Drive
20 Thread
21 Inlet side
22 Outlet side
23 Bearing
24 Groove
25 Sliding seal
26 Pressure piston
27 Piston bracket
28.1, 28.2, 28.3 Seal
29 Transverse groove
30 Inner casing
31 Outer casing
32 End side
33 End side
34 Steps
35 Step groove
36 Pressure chamber

The invention claimed is:

1. A device for producing intertwining knots in a multifilament thread comprising:

a rotating nozzle ring having an encircling guide groove on an outer casing, an encircling sealing surface on an inner casing, and an end wall with an end sealing surface;

at least one nozzle bore that opens radially into the guide groove and passes through the nozzle ring;

a stator having an encircling sliding surface on its periphery for guiding the nozzle ring, wherein the encircling sealing surface of the nozzle ring cooperates with the encircling sliding surface of the stator for air sealing and wherein the stator has an end sliding surface on one end side that interacts with the end sealing surface of the nozzle ring in order to provide air sealing; and, a pressure chamber having at least one chamber opening that opens into the encircling sliding surface, wherein at least one of the encircling sliding surface and the end sliding surface of the stator have a plurality of grooves arranged next to one another.

2. The device according to claim 1, further comprising a radial gap disposed between the encircling sliding surface of the stator and the encircling sealing surface of the nozzle ring.

3. The device according to claim 2 wherein the radial gap has a gap height ranging from 0.01 to 0.1 mm.

4. The device according to claim 2, further comprising an axial gap formed between the end sliding surface of the stator and the end sealing surface of the nozzle ring, wherein the axial gap has a gap height equal to the radial gap.

5. The device according to claim 1, wherein the grooves have a constant groove depth and a constant groove width.

6. The device according to claim 5, wherein a ratio between the groove width and groove depth lies in the range of 2 to 6.

7. The device according to claim 1, wherein at least one of the encircling sealing surface and the end sealing surface of the nozzle ring have a plurality of grooves arranged next to one another.

8. The device according to claim 7, wherein grooves are provided on the end sealing surface of the nozzle ring and the grooves are provided on the end sliding surface of the stator such that the grooves provided on the end sealing surface of the nozzle ring and the grooves provided on the end sliding surface of the stator are offset to one another in order to produce an overlapping between the end sealing surface of the nozzle ring with the end sliding surface of the stator.

9. The device according to claim 1, wherein step grooves are provided in the encircling sealing surface of the nozzle ring and, the encircling sliding surface of the stator has staggered steps that interact with opposing step grooves in the encircling sealing surface of the nozzle ring.

10. The device according to claim 1, wherein a sliding seal is arranged on the periphery of the stator to interact with a free end side of the nozzle ring.

11. The device according to claim 1, further comprising a plurality of axial transverse grooves arranged next to one another provided on the periphery of the stator in a section of the encircling sliding surface in which the chamber opening is provided.

12. The device according to claim 1, further comprising a cover partially covering the guide groove opposite the chamber opening of the stator and being associated with the nozzle ring.

* * * * *